US007385310B2

(12) United States Patent
Brauckmann et al.

(10) Patent No.: US 7,385,310 B2
(45) Date of Patent: Jun. 10, 2008

(54) ELECTRONIC BALLASTS WHICH CAN BE CONNECTED IN PARALLEL ON THE BASIS OF THE TYPE OF LAMP

(75) Inventors: Wilfried Brauckmann, Wendeburg (DE); Ulrich Klipstein, Wendeburg (DE)

(73) Assignee: B&S Elektronische Geräte GmbH, Braunschweig (DE)

( * ) Notice: Subject to any disclaimer, the term of this patent is extended or adjusted under 35 U.S.C. 154(b) by 365 days.

(21) Appl. No.: 10/493,911

(22) PCT Filed: Oct. 15, 2002

(86) PCT No.: PCT/DE02/03928

§ 371 (c)(1),
(2), (4) Date: Feb. 16, 2005

(87) PCT Pub. No.: WO03/039204

PCT Pub. Date: May 8, 2003

(65) Prior Publication Data

US 2005/0151426 A1 Jul. 14, 2005

(30) Foreign Application Priority Data

Oct. 27, 2001 (DE) ..... 101 53 123

(51) Int. Cl.
*H05B 31/30* (2006.01)
*H05B 37/02* (2006.01)

(52) U.S. Cl. ..... 307/29; 307/86; 307/157; 315/315; 315/324

(58) Field of Classification Search ..... 307/19, 307/23, 29, 86, 157, 44; 362/212; 315/324, 315/313, 297, 315

See application file for complete search history.

(56) References Cited

U.S. PATENT DOCUMENTS

| | | | | |
|---|---|---|---|---|
| 3,141,112 | A * | 7/1964 | Eppert | 315/231 |
| 5,177,404 | A * | 1/1993 | Cohen et al. | 315/154 |
| RE35,994 | E * | 12/1998 | Lestician | 315/291 |
| 6,091,164 | A | 7/2000 | Buell | |
| 6,188,181 | B1 * | 2/2001 | Sinha et al. | 315/293 |
| 6,414,449 | B1 * | 7/2002 | Hui et al. | 315/291 |
| 6,703,722 | B2 * | 3/2004 | Christensen | 307/71 |
| 6,731,080 | B2 * | 5/2004 | Flory | 315/312 |

FOREIGN PATENT DOCUMENTS

| | | |
|---|---|---|
| DE | 101 39 402 | 3/2003 |
| FR | 2 811 506 | 1/2002 |
| JP | 8-186041 | 7/1996 |

* cited by examiner

*Primary Examiner*—Michael J Sherry
*Assistant Examiner*—Andrew M Deschere
(74) *Attorney, Agent, or Firm*—Whitham Curtis Christofferson & Cook, PC

(57) ABSTRACT

The invention relates to the supply of lamps (8'', 8''') of at least two different lamp types, of which a first lamp type (8''') has a wattage which is approximately a whole multiple of the wattage of a second lamp type (8''), whereby the same ballast devices (1) are used, embodied for the direct supply of the second lamp type (8'') and which may be operated in parallel for the supply of the first lamp type (8'''). The correct connection of a suitable lamp (8', 8'', 8''') to the ballast device (1) is monitored by means of a signal exchange between ballast device (1) and lamps (8', 8'', 8''') before switching on the supply line of the ballast device (1).

5 Claims, 4 Drawing Sheets

ELECTRONIC BALLASTS WHICH CAN BE CONNECTED IN PARALLEL ON THE BASIS OF THE TYPE OF LAMP

The invention relates to a method for producing a suitable connection between a luminaire and an electronic ballast which provides a suitable power supply for the luminaire, in which, prior to the power supply being connected to the luminaire, a signal is transmitted from the ballast, a response signal which is specific to the type of luminaire is generated by means of the luminaire on the basis of the transmitted signal, the response signal is evaluated in the ballast for the purpose of detecting the type of luminaire connected, and only after a type of luminaire has been detected which is suitable for connection is the power supply connected.

The invention further relates to an arrangement of electronic ballasts which each have a power supply unit for generating a power supply for operating a connected luminaire, a connection cable for producing an electrical connection with the luminaire for transmitting the power supply, a control device by means of which, prior to the power supply being connected, a signal is transmitted to the luminaire, an evaluation device for evaluating a response signal from the luminaire for the purpose of detecting the type of luminaire and evaluating the type of luminaire detected as being suitable for connection to the power supply, and a switching device for connecting the power supply if the type of luminaire detected is suitable for connection to the power supply.

BACKGROUND

Numerous luminaires provided with discharge lamps are regularly used for illuminating exhibition stalls, exhibition areas, scenes for films etc. Frame-like stands are often used for this purpose on which the luminaires are mounted and connected to a connecting cable. The connecting cable connects the luminaires to an associated electronic ballast. Owing to the high number of luminaires which are often used, the electronic ballasts are often inserted in large numbers in standard withdrawable part housings. In order to reduce the number of cables, which are sometimes routed over a relatively long distance, the connecting lines of the electronic ballasts are increasingly connected to a single, multicore cable, which is used to largely bridge the distance between the electronic ballasts and the luminaires. A distribution board is fitted at the luminaire end of the multicore cable, and the individual luminaires can then be connected to this distribution board.

In order to perform the respective illumination tasks, luminaires having different power ratings are generally used. It is known to provide the luminaires having different power ratings with different plugs in order to prevent, for example, a luminaire having a lower power rating being connected to an electronic ballast having a higher output power rating or vice versa, which could result in damage to the discharge lamp of the luminaire or to the electronic ballast. However, one disadvantage of this is the fact that the distribution board which is connected to the multicore cable needs to be equipped with mating plugs which are correspondingly mechanically coded so that the distribution board needs to be specially designed for the respective illumination task. This is inconvenient and requires, for example, a relatively large amount of modification work if it is established when the illumination system is set up that at one or more points a luminaire having a prescribed power rating needs to be replaced by a luminaire having a different power rating.

SUMMARY

The invention therefore proposes that the mechanical coding of the plugs is dispensed with and that more care is taken by the installers to prevent luminaires being incorrectly connected to electronic ballasts. Prerequisites for this are the careful assignment and labeling of the connections of the luminaire-side distribution board to the individual electronic ballasts at the other end of the multicore cable and also that great care be taken by the installers.

There is no guarantee that the operators will make no errors in their work, owing to the installation conditions which are often confined in the region of the distribution board, for example on a narrow luminaire frame, and owing to the generally problematic light conditions which are present. It therefore appears impossible to avoid installation errors and the damage to lamps and/or electronic ballasts associated with these installation errors.

This application addresses the problem of avoiding, without considerable additional effort, damaging consequences of incorrect installations owing to plug connections no longer being mechanically coded.

Based on this problem, the the application proposes a method for producing a suitable connection between a luminaire and an electronic ballast which provides a suitable power supply for the luminaire, characterized in that, prior to the power supply being connected to the luminaire, a signal is transmitted by the ballast, in that a response signal which is specific to the type of luminaire is generated by means of the luminaire on the basis of the transmitted signal, in that the response signal is evaluated in the ballast for the purpose of detecting the type of luminaire connected, and in that only after a type of luminaire has been detected which is suitable for connection is the power supply connected.

This method thus provides an electronic means of checking the luminaire connected to the electronic ballast in question before the power supply is connected by the electronic ballast. This does not prevent an unsuitable luminaire from being connected to an electronic ballast, but operation of the luminaire is prevented from being started by the electronic ballast.

The type of luminaire, i.e. in particular the rated power of the luminaire, can be checked without additional lines by means of the connecting cable which is, for example, in the form of a two-conductor cable. The circuitry complexity which is required for the electronic ballast and for the luminaire is low since the information on the type of luminaire can be transmitted in a very simple manner, for example by pulses generated in the luminaire, the number of pulses per unit time containing the information on the type of luminaire. In this case, for example, it is sufficient to use just a pulse generator in the form of an astable multivibrator, whose switching frequency can be established by it being connected to a capacitor.

In principle it is possible for the response signal generator to be supplied with power by a dedicated battery in the luminaire. However, a solution is preferred in which the response signal is generated in the luminaire from the energy from the received signal such that the luminaire can continue to operate without having a dedicated power source. For this purpose, for example, a low DC voltage can be transmitted as a signal and is switched, as a response signal, by the signal generator in the luminaire in a pulsed manner between a low resistance value and a high resistance value such that, depending on the circuitry, voltage pulses are produced or, at a constant voltage, current pulses can be detected in the electronic ballast.

Another embodiment consists in a pulse signal which is temporally limited being transmitted as a signal from the electronic ballast, and a response signal being formed from the energy content of said pulse signal by means of the luminaire. The pulse signal may be used in the luminaire, for example for charging a capacitor, and the energy from said capacitor is used to form the response signal which is temporally limited. The invention expediently provides for the device for forming the response signal in the luminaire to be designed such that it can switch itself off, so that it switches itself off when the power supply is fed to the luminaire.

An electronic ballast which is suitable for carrying out the method according to the main patent is characterized by a control device, by means of which, prior to the power supply being connected, a signal is transmitted to the luminaire, by an evaluation device for evaluating a response signal from the luminaire for the purpose of detecting the type of luminaire and evaluating the type of luminaire detected as being suitable for connection to the power supply, and by a switching device for connecting the power supply if the type of luminaire detected is suitable for connection to the power supply.

In this case, a DC voltage which is considerably lower than the power supply voltage can be produced at the output of the control device for transmission to the luminaire. In accordance with the method of operation described above, it may be sufficient for a temporally limited pulse of the low DC voltage to be produced at the output of the control device for transmission to the luminaire.

The output of the control device may be connected to the connection cable such that the low DC voltage is transmitted using the same cable as is later used for feeding the power supply to the luminaire.

The evaluation device may be designed in a simple manner for the purpose of detecting the number of pulses per unit time.

Naturally, the evaluation device within the scope of the invention may also be of a different design, for example for the purpose of detecting pulse widths, for the purpose of detecting zero crossings of a harmonic oscillation etc.

In accordance with this application, a luminaire for carrying out the method is characterized by a signal transmitter, which is triggered by a signal which is fed in from outside, for transmitting a response signal to the ballast which characterizes the type of luminaire. In this case, the signal transmitter may expediently be supplied with the signal which is fed in from outside, i.e. be provided with its supply voltage.

The signal transmitter is preferably connected to the connection cable and thus receives, via the same line, both the signal which is fed in from outside and the power supply.

The signal transmitter is preferably designed such that it can switch itself off once the response signal has been emitted. The signal transmitter is reactivated by another signal, which is fed in from outside, is markedly different from the power supply and can be detected by the signal transmitter.

For the reasons described above, it is advantageous if the signal transmitter has an energy storage device for forming its supply voltage from a received signal.

Alternatively, the signal transmitter can have a received DC voltage supplied to it and can switch the DC voltage in a pulsed manner.

In particular when connecting a large number of luminaires for different illumination tasks and therefore having different power consumptions, there is the problem that different ballasts need to be provided for the different types of luminaire and that these ballasts need to be accommodated in a withdrawable part rack housing, for example. Since it has been possible in the meantime to reduce the size of the electronic ballasts to such an extent that two or more can be accommodated next to one another in a 19-inch withdrawable part, it is extremely problematic, for example, to replace a ballast of one power type with a ballast of another power type since the ballasts usually have different widths.

The invention is therefore based on the problem of simplifying the way in which numerous ballasts are dealt with and arranged for the purpose of operating luminaires of different types.

Based on this problem, identical ballasts are used for supplying power to luminaires of at least two different types, of which a first type has a power consumption which is about an integral multiple of the power consumption of a second type of luminaire, these ballasts being designed to supply power directly to the second type of luminaire and being operated, connected in parallel, for the purpose of supplying power to the first type of luminaire.

A corresponding arrangement of electronic ballasts of the type mentioned initially is characterized in that, according to the invention, identical ballasts are provided in the arrangement which are designed to supply power directly to luminaires of the second type and can be connected in parallel for the purpose of supplying power to luminaires of the first type.

The present invention makes use of the fact that, although different types of luminaire are often used, the number of types of luminaire used is limited to two or three. A combination of luminaires which is often used uses three types of luminaire having power consumptions of 200 W, 575 W and 1200 W. According to the invention, identical ballasts are used for driving the 575 W and 1200 W luminaires, these ballasts being designed to supply power directly to 575 W luminaires.

Two ballasts are connected in parallel for the purpose of driving the 1200 W luminaire. This makes it possible to avoid the otherwise usual variety of electronic ballasts. In one specific case, electronic ballasts are used which can be switched internally between an output power of 200 W and 575 W for the low power outputs, the correct switch position for the connection of a specific luminaire being checked in accordance with the method, or automatic switching taking place in accordance with this method.

The use of identical ballasts advantageously makes it possible for them to be arranged next to one another in a standard withdrawable part housing, it being advantageous for six ballasts to be arranged next to one another in a 19-inch withdrawable part housing for the described application.

Since the ballasts are, as is standard, designed such that their output power can be regulated, it is, for example, also possible according to the present invention to operate a luminaire having a power consumption of 800 W using two parallel-connected ballasts having a power output of up to 600 W if, for example, the two ballasts have been controlled such that they are at a level of 400 W.

DESCRIPTION OF THE DRAWINGS

The invention will be explained in more detail below with reference to the exemplary embodiments depicted in the drawings.

DETAILED DESCRIPTION

Figure 1:
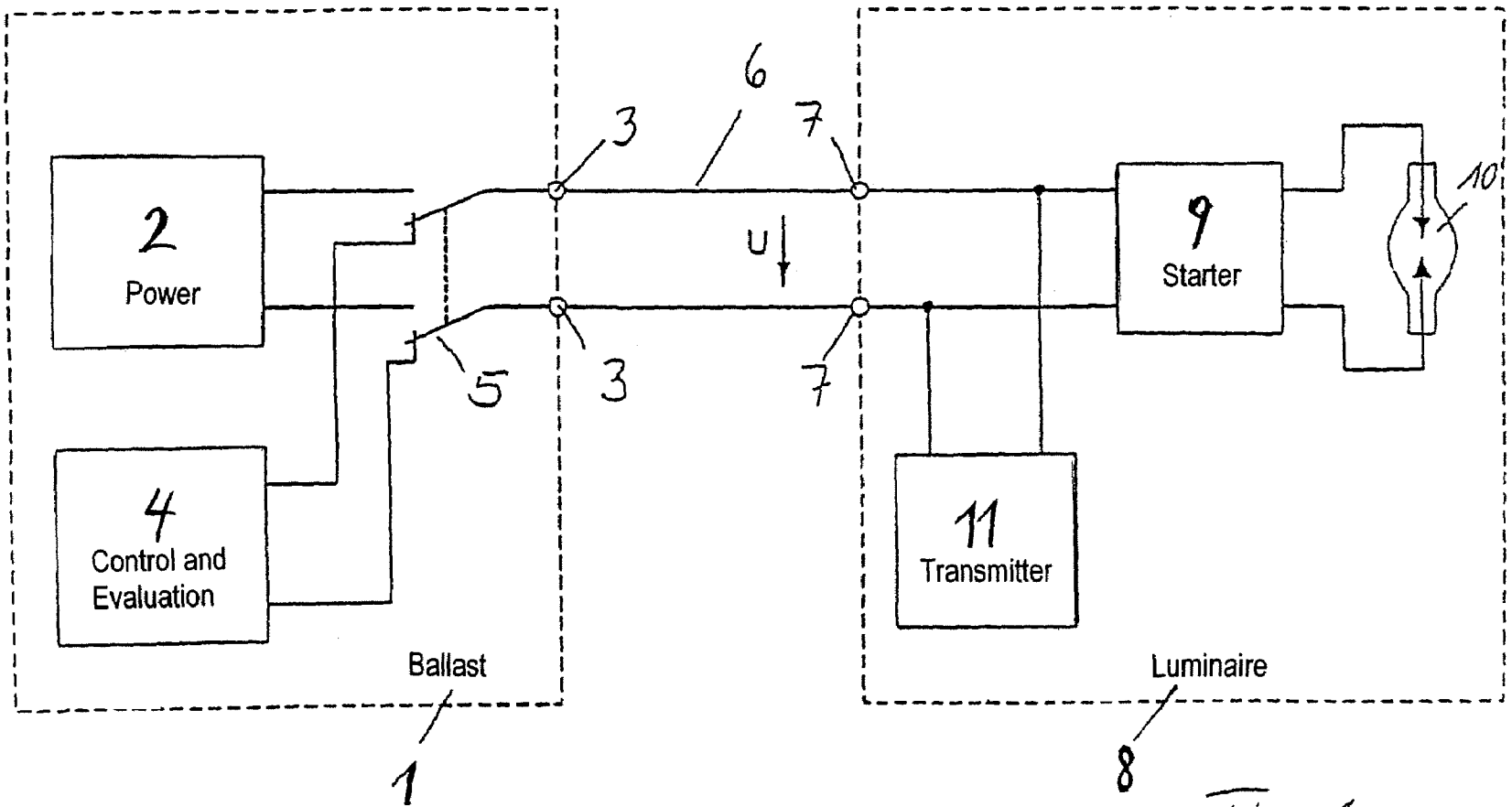
FIG. 1 shows a block diagram of an electronic ballast and a luminaire connected via a connection cable.

FIG. 1 shows, schematically, an electronic ballast 1, which generally has a power section 2 by means of which a power supply is produced and is made available at output terminals 3.

The electronic ballast also has a control and evaluation device 4, whose output terminals can, as an alternative, be switched by means of a change-over switch 5 to supply power to the output terminals 3. A connection is produced with the connection terminals 7 of a luminaire 8 by means of a two-core connection cable 6. A starter 9 and a discharge lamp 10 are connected in the conventional manner in the luminaire 8 to the connection terminals 7.

In parallel with the starter 9, a signal transmitter 11, which may be in the form of a pulse emitter, is connected to the connection terminals 7.

The connection cable 6 illustrated schematically is often part of a multicore cable which combines numerous connection cables 6 to form one cable. Correspondingly, the luminaire 8 is connected via a distribution board by means of which it is possible for the numerous, combined connection cables 6 to be separated again and assigned to individual luminaires 8.

Figure 2:
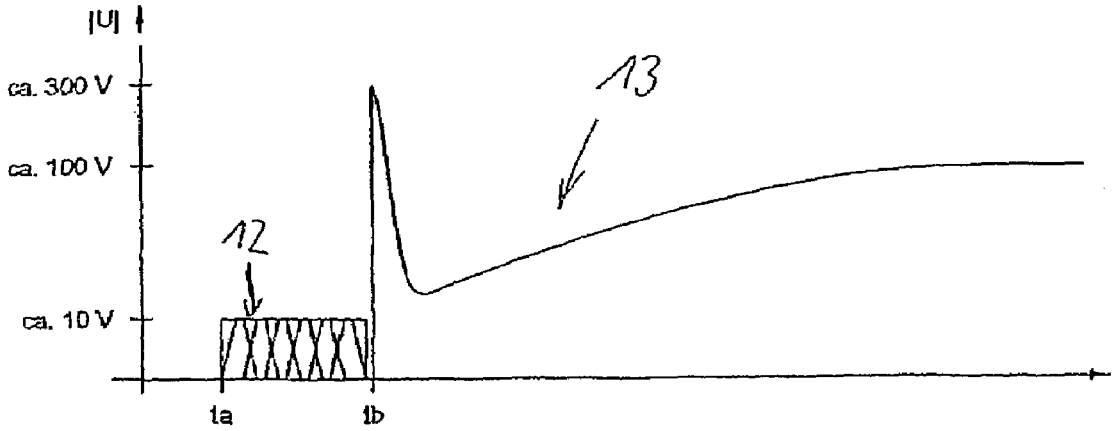
FIG. 2 shows an illustration of the waveform for the output voltage of the electronic ballast during the test procedure for the type of luminaire and for the subsequent connection of the power supply.

FIG. 2 illustrates the voltage waveform on the connection line 6. Once the luminaire 8 has been connected to the connection cable 6 which is connected to the electronic ballast 1, communication signals 12 are initially transmitted at a low voltage of approximately 10 V for the purpose of checking the type of luminaire connected. If this transmission shows that a luminaire 8 has been correctly connected, the change-over switch 5 in the electronic ballast 1 switches such that the power supply from the power section 2 is transmitted by means of the connection cable 6. This starts the lamp 10 by means of the starter 9, as a result of which the supply voltage of approximately 300 V is applied in, and then a transition is made to the stable operating state of the discharge lamp 10, as is illustrated with reference to the curve profile 13 in FIG. 2.

Figure 3A:
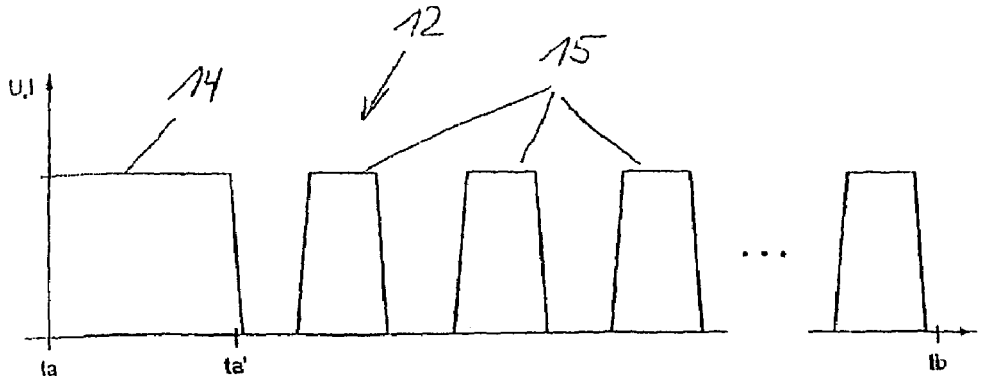
FIG. 3 shows a signal characteristic for a signal, which is generated and transmitted by the electronic ballast, in the form of a DC voltage pulse and of a response signal generated on that basis.
Figure 3B:
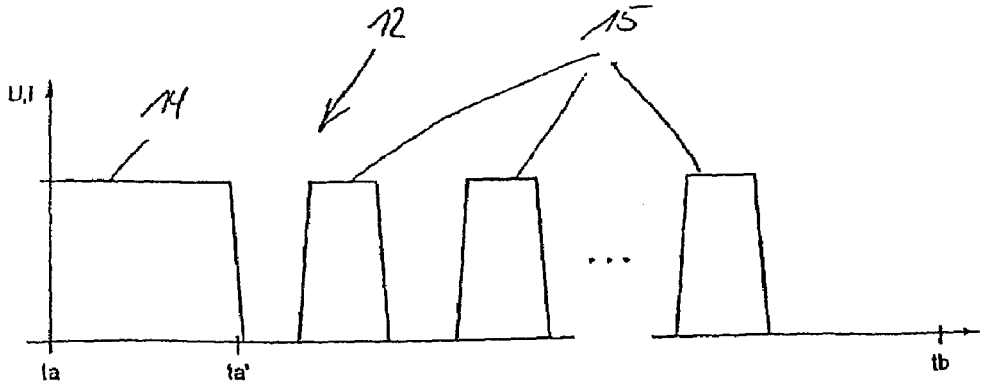

FIG. 3 shows an example of the test signals 12, which in this case comprises a DC voltage pulse 14 transmitted by the control/evaluation device 4 and having the pulse width ta-ta' and a response signal 15 following this which is generated by the signal transmitter 11, is in the form of voltage pulses or current pulses and is concluded at time tb. The signal transmitter 11 draws its supply voltage from the energy of the DC voltage pulse 14. The number of pulses 14 transmitted by time tb in FIG. 3*a* is greater than the number in FIG. 3*b*, and therefore characterizes another type of luminaire.

As mentioned, the DC voltage 14 may alternatively be continuously transmitted up to time tb if the pulse transmitter then switches this DC voltage in a pulsed manner between a low resistance value and a high resistance value, as a result of which current pulses are detected in the control/evaluation device 4 and, for example with respect to the number of pulses by time tb, code the type of luminaire.

The exemplary embodiments illustrated show a very simple arrangement of a luminaire 8 which makes possible very simple communication in the form of test signals 12. Of course, the described method may also be used for luminaires 8 which are the subject of complicated control processes, for example have actuating motors, by means of which they can be pivoted to a specific position allowing different color filters to be switched effectively etc. In this case, the communication with the test signals 12 may go beyond detection of the type of luminaire and also serve the purpose of transmitting control signals for the actuating motors, operating devices for color filters, etc.

It can easily be seen that the described method allows mechanical plug coding to be dispensed with without there being any risk of the electronic ballast 1 or the discharge lamp 10 being damaged owing to an incorrect connection of a luminaire 8 to an electronic ballast 1.

Figure 4:
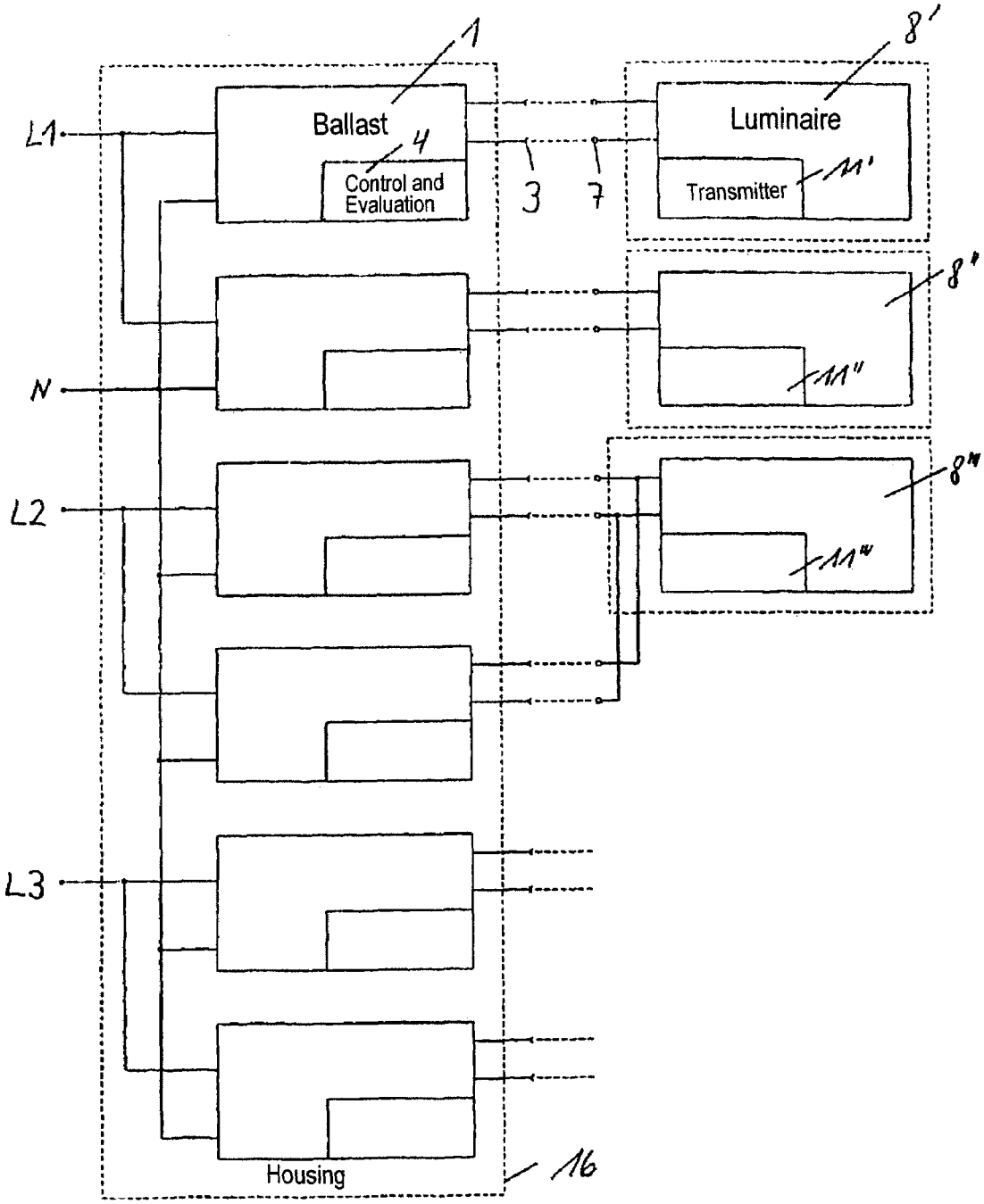
FIG. 4 shows a schematic illustration of six identical ballasts for driving luminaires of different types.

FIG. 4 shows an arrangement of six ballasts 1, in one withdrawable part housing 16 which may be a 19-inch standard withdrawable part. The ballasts 1 can in each case be switched for the purpose of supplying power directly to two types of luminaire 8', 8" whose power consumption is 200 W and 575 W, respectively.

The six ballasts 1, in groups of two ballasts 1 for each phase L1, L2, L3 of a three-phase terminal, are supplied with voltage with respect to a neutral conductor N.

The ballast 1 illustrated at the top in FIG. 4 is connected to operate at 200 W and supplies power directly to a luminaire 8' whose power consumption is 200 W.

The ballast 1 illustrated beneath is, on the other hand, connected to operate at an output power of 575 W, and supplies power directly to a luminaire 8' whose power consumption is 575 W.

Checking, as described above, that there is a suitable connection between the ballast 1 and the luminaire 8', 8" ensures that the power supply of the ballast 1 is passed on only to a luminaire 8', 8" suitable for this purpose, too.

The luminaire 8''' which is also illustrated has a power consumption of 1200 W and is therefore driven by two parallel-connected ballasts 1 such that two ballasts 1 are required for supplying power to the luminaire 8'''. The output terminals 3 of two ballasts 1 are therefore connected in parallel with the input terminals 7 of the luminaire 8'''.

This illustrates that the luminaires 8" and 8''' can be driven by the same type of ballasts 1 whose output power is approximately 575 W, and specifically that the luminaire 8" can be driven directly by a ballast 1 and the luminaire 8''' can be driven by means of two parallel-connected ballasts 1.

The further type of luminaire 8' is also supplied with power when the ballast used, as is often the case, can be switched in the lower power range such that, after switching, power may also be supplied directly from the ballast 1 to the luminaire 8' with the low power consumption.

If the ballasts 1 for supplying power to the luminaire 8''' are connected in parallel, it is possible, for the purpose of detecting a suitable connection of the luminaire 8''' to the ballast 1, to produce a response signal 15 characterizing the power consumption "1200 W". In this case, the ballast 1 recognizes that it is possible to supply power to the luminaire 8''' only by means of two-parallel-connected ballasts 1, but that it itself must be connected in the "600 W" position.

It is also possible for a response signal "600 W" to be transmitted by, the luminaire 8''' since the ballast 1 only requires information as to whether a luminaire 8''' is connected which has a power consumption suitable for the high output power.

If, inadvertently, there is no parallel connection of two ballasts 1, but only a single ballast is connected to the luminaire 8''', this results in noticeably poorer operation of the luminaire 8''' or in its failure to operate, and this problem is alleviated by the parallel connection of two ballasts 1. In this case it is not possible for the luminaire 8''' to be damaged.

It is of course also possible to detect whether two ballasts 1 are connected in parallel correctly. However, the complexity required here is generally not worthwhile since it is possible to recognize straightaway from the operation of the luminaire 8''' if there is no parallel connection.

The advantageous, modular arrangement according to the invention of the ballasts 1 in one housing 16 may also be used for supplying power to types of luminaire having a higher power consumption, for example 1800 W, by two or more, for example three, ballasts 1 being connected in parallel. In practice, however, the parallel connection of two ballasts 1 is generally sufficient.

The invention claimed is:

1. A method for establishing a connection between a luminaire and an electronic ballast, said luminaire being of a certain type selected from at least two different types of luminaires having different power consumptions where a first type of luminaire has a power consumption which is about an integral multiple of the power consumption of a second type of luminaire, wherein said ballast provides a power supply for the luminaire by supplying a supply voltage, comprising the steps of:

prior to supplying said supply voltage to the luminaire, a signal which is not the supply voltage is transmitted from the ballast to the luminaire connected to the ballast;

responding to said signal by said luminaire with a response signal which is specific to said certain type;

evaluating said response signal to determine said certain type of luminaire connected; and supplying said supply voltage from said power supply to said luminaire only when said luminaire is said certain type which can be supplied by said ballast, wherein said ballast is designed to supply power directly to the second type of luminaire, and at least two identical ballast units are connected in parallel to supply power to the first type of luminaire.

2. An arrangement of electronic ballasts for operating a connected luminaire, wherein said connected luminaire is selected from at least two different types of luminaires having different power consumptions where a first type of luminaire has a power consumption which is about an integral multiple of the power consumption of a second type of luminaire, comprising:

at least two identical ballast units, each of said at least two identical ballast units have a power supply unit for generating a power supply;

a connection cable for producing an electrical connection with the connected luminaire a ballast unit of said two identical ballast units to provide said connected luminaire with the power supply;

a control device associated with said ballast unit which, prior to the power supply of said ballast unit being provided to said connected luminaire, transmits a signal to the connected luminaire, and evaluates a response signal from the connected luminaire to determine if the connected luminaire is suitable for connection to the power supply; and a switching device for connecting the power supply if the type of luminaire detected from said response signal is suitable for connection to the power supply, wherein said at least two identical ballasts are provided in the arrangement to supply power directly to the second type of luminaire and can be connected in parallel for supplying power to the first type of luminaire.

3. The arrangement as claimed in claim 2, wherein said at least two identical ballasts are connected for the purpose of supplying power directly to different types of luminaire.

4. The arrangement as claimed in claim 2, wherein a number of ballasts of said at least two identical ballasts are arranged next to one another in a standard withdrawable part housing.

5. The arrangement as claimed in claim 4, wherein said number of ballasts is six and wherein said standard withdrawable part housing is a 19-inch withdrawable part housing.

* * * * *